US006606960B1

(12) United States Patent
Leibolt et al.

(10) Patent No.: US 6,606,960 B1
(45) Date of Patent: Aug. 19, 2003

(54) SCUBA DIVER FAIRING

(75) Inventors: Edward A. Leibolt, Wheaton, MD (US); Logan P. Rainard, Wheaton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 40 days.

(21) Appl. No.: 09/784,186

(22) Filed: Feb. 15, 2001

(51) Int. Cl.[7] ..... B63C 11/46
(52) U.S. Cl. ..... 114/315
(58) Field of Search ..... 114/315, 320, 114/330–333, 338, 253, 244, 242; 441/135

(56) References Cited

U.S. PATENT DOCUMENTS

| | | | | |
|---|---|---|---|---|
| 1,199,277 A | | 9/1916 | Kelly | |
| 1,324,961 A | * | 12/1919 | Grantham | 114/331 |
| 2,850,011 A | | 9/1958 | Schaefer | |
| 3,048,140 A | * | 8/1962 | Davis, Sr. | 440/38 |
| 3,131,664 A | * | 5/1964 | McInvale | 114/315 |
| 3,160,133 A | * | 12/1964 | Walker | 114/245 |
| 3,204,264 A | | 9/1965 | Tamura et al. | |
| 3,204,596 A | * | 9/1965 | Fallon | 114/315 |
| 3,618,551 A | * | 11/1971 | Deslierres | 114/315 |
| 5,988,096 A | * | 11/1999 | Benesch et al. | 114/244 |
| 5,997,369 A | * | 12/1999 | Triantafyllou | 440/21 |

FOREIGN PATENT DOCUMENTS

| | | | | |
|---|---|---|---|---|
| DE | 3739887 | * | 6/1989 | 114/315 |
| FR | 1148743 | * | 12/1957 | 114/315 |
| FR | 1426399 | * | 12/1966 | 114/315 |
| FR | 1499177 | * | 9/1967 | 114/315 |
| GB | 6345 | * | of 1889 | 114/135 |
| GB | 234219 | * | 5/1925 | 114/87 |
| JP | 61-200090 | * | 9/1986 | 114/315 |
| JP | 62-178497 | * | 8/1987 | 114/315 |
| JP | 03-248994 | * | 11/1991 | 114/315 |
| JP | 3-276898 | * | 12/1991 | 114/315 |
| JP | 03-276898 | * | 12/1991 | 114/315 |

* cited by examiner

*Primary Examiner*—S. Joseph Morano
*Assistant Examiner*—Ajay Vasudeva
(74) *Attorney, Agent, or Firm*—Jacob Shuster

(57) ABSTRACT

A protective fairing encloses the head and torso of a SCUBA diver wearing diving equipment, with clearance throughout. A viewing shell section of the fairing covering the diver head is attached to a torso covering shell section to form a hydrodynamic shape facilitating forward underwater movement by reducing drag. Such torso shell section has vent holes formed therein to prevent water displacement within the fairing by air and is provided with buoyancy distributing weights to neutralize the effect of positive buoyancy during forward movement through seawater.

5 Claims, 2 Drawing Sheets

SCUBA DIVER FAIRING

The present invention relates generally to protective covering of a SCUBA diver during underwater activity.

BACKGROUND OF THE INVENTION

The provision of protective coverings for persons during underwater activity is generally well known. Protective coverings or fairings made of water resistant, semi-rigid materials, and having transparent viewing facilities are also known in the art. Such coverings which feature for example close-fitting bathing suits, body sealed hoods, jackets and helmets, are unsuitable for protective enclosure of a SCUBA diver wearing diving equipment during underwater activity because of difficulties and problems in enclosing both the diver and equipment without discomfort to the diver and impedance of underwater diver movement. It is therefore an important object of the present invention to provide a protective covering or fairing for a SCUBA diver which will avoid the aforementioned difficulties and problems, as well as to enhance forward underwater movement.

SUMMARY OF THE INVENTION

In accordance with the present invention, a fairing as a protective underwater covering encloses both the head and torso of a SCUBA diver, wearing the usual diving equipment, with comfort providing clearance throughout. Such fairing has a hydrodynamic shape to enhance forward underwater movement of the diver by reducing seawater drag and further neutralizes inducement of upward surface flotation forces by venting of any diver exhaust gas in the fairing through holes formed in the top and rear end of its torso covering shell section, which is fixed to an upper transparent head covering shell section through which diver viewing is accommodated. Buoyancy distributing weights are fixedly mounted at appropriate spaced locations in the torso shell section of the fairing to neutralize inducement of upward surface flotation. An insertion opening of maximum cross-sectional fairing dimension is formed at the end of the torso covering section to accommodate facilitated entry of the diver into the fairing.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
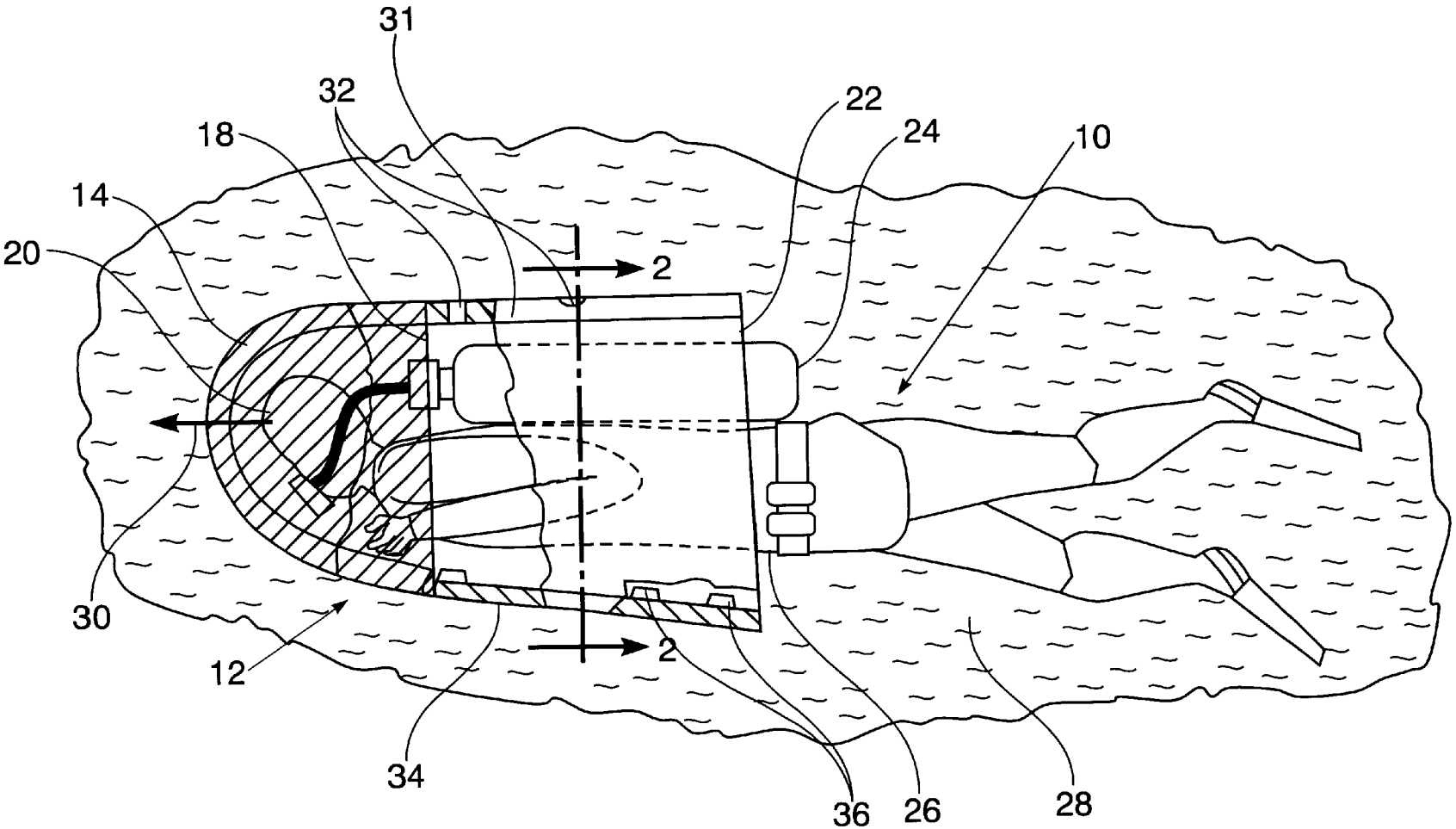
FIG. 1 is a side elevation view, with portions shown in section, of a SCUBA diver wearing diving equipment covered by a protective fairing constructed in accordance with the present invention.

Referring now to the drawing in detail, FIG. 1 illustrates a SCUBA diver 10 enclosed within a seawater protective fairing 12 which is of a continuous construction including a shell section 14 and a torso shell section 16. The shell section 14 which covers the diver head 20 is made of a transparent material for diver viewing purposes. The torso shell section 16 of the fairing 12 is made or a semi-rigid opaque material. Such fairing shell sections 14 and 16 are firmly interconnected at a location 18 to enclose the head 20 of the SCUBA diver 10 within the shell section 14 of the fairing 12 when positioned therein, thereby protectively enclosing the diver head 20 and the diver torso down to the diver waist 26. At the end of the torso shell section 16 opposite location 18 and adjacent to the diver waist 26, it forms an insertion opening 22 for entry of the diver 10 wearing all of the usual diving equipment including a tank 24. Such entry insertion opening 22 accordingly has the maximum cross-sectional dimension of the fairing 12 so as to accommodate its insertion over the top of the diver 10 and displacement to the position shown in FIG. 1, completely and protectively covering the head and torso of the diver 10 with clearance spacing throughout, as well as to cover all of the diving equipment being carried including the tank 24 projecting from the entry end opening 22.

Figure 2:
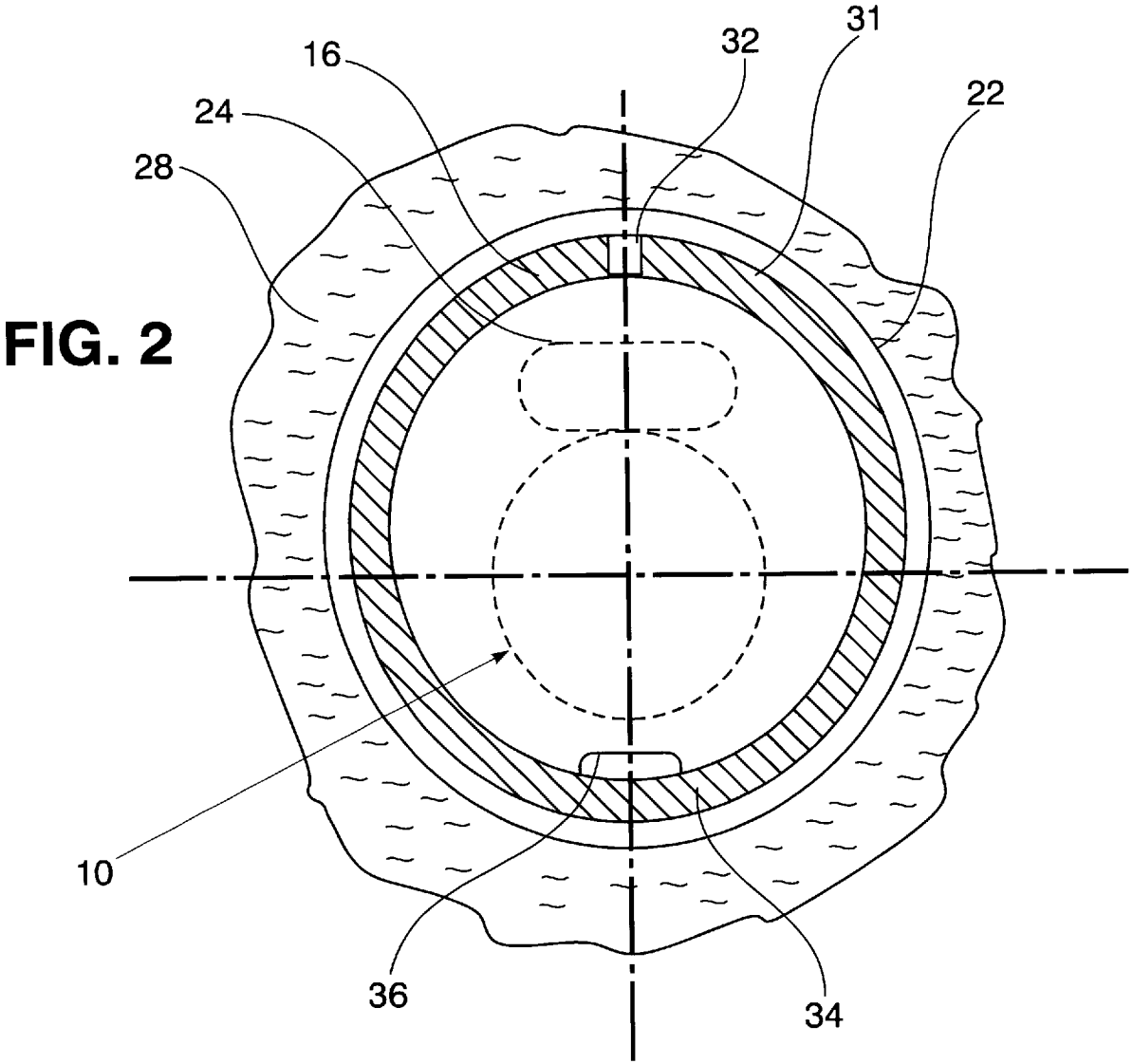
FIG. 2 is a sectional view of the fairing within seawater, taken substantially through a plane indicated by section line 2—2 in FIG. 1.

FIG. 2 illustrating the cross-sectional configuration of the shell construction of the fairing 12 with the diver 10 and equipment tank 24 positioned therein, shows that it has a generally circular shape for example in cross-section that does not conform to the diver 10 and allows diver entry and exit. FIG. 1 illustrates the hydrodynamic shell shape of the fairing 12 formed by the shell sections 14 and 16 so as reduce drag imposed by seawater 28 during forward movement therein in a direction 30. Such underwater movement of the diver 10 in the forward direction 30 at increased speeds is accordingly enhanced with reduced effort.

With continued reference to FIGS. 1 and 2, it will be apparent that both air and water will enter the fairing 12 through its entry opening 22 during underwater activity. To avoid any possible resulting water displacement by any air or exhaust gas within the fairing 12, the torso covering shell section 16 is provided along its rear end portion 31 behind the diver 10 with spaced vent holes 32. Also, along the forward portion 34 of the torso shell section 16 in front of the diver 10 a plurality of buoyancy distributing weights 36 are fixedly mounted at appropriate spaced locations to obtain a neutral buoyancy condition. A positive type of water surface flotation buoyancy which would induce upward movement of the diver 10 covered by the fairing 12 within the seawater 28 is thereby avoided by neutralization of such positive buoyancy.

Obviously, other modifications and variations of the present invention may be possible in light of the foregoing teachings. It is therefore to be understood that within the scope of the appended claims the invention may be practiced otherwise than as specifically described.

What is claimed is:

1. An underwater protective fairing adapted for covering head and torso of a SCUBA diver wearing diving equipment, comprising: a shell having a head covering section for completely covering the head of the diver and a torso covering section extending from the head covering section at a location on the shell adjacent the head of the diver for enclosure of the head and the torso as well as the diving equipment, with clearance throughout, the torso shell section being made of a semi-rigid material having an end opposite said location on the shell of maximum cross-sectional fairing dimension forming an opening through which entry of the diver wearing the equipment is accommodated, vent means formed in the torso covering shell section spaced from said insertion opening for preventing water displacement by gas within the fairing; and buoyancy distributing weight means forwardly mounted in the torso covering shell section for neutralizing positive flotation buoyancy of the fairing in water during movement through seawater.

2. In combination with a fairing for protectively enclosing head and torso of a diver during movement underwater, said fairing having a head shell section extending from one axial end thereof and a torso shell section interconnected therewith with an insertion opening at an opposite axial end thereof for receiving the diver within the fairing, the improvement residing in: means for enhancing said underwater movement under positive buoyancy conditions, comprising: a plurality of weights; means for positioning said weights at a plurality of appropriately distributed axially spaced locations inside of the torso shell section to oppose upward forces on the fairing with the diver therein under said positive buoyancy conditions; and means mounted in the torso shell section for venting gas from the fairing during said underwater movement to prevent displacement of water there from through the insertion opening.

3. An underwater protective fairing adapted for covering head and torso of a SCUBA diver wearing-diving equipment, comprising: a shell having a head covering section for completely covering the head of the diver and a torso covering shell section extending from the head covering section at a location on the shell adjacent the head of the diver for enclosure of the head and the torso as well as the diving equipment, with clearance throughout, the torso shell section being made of a semi-rigid material having an end opposite said location on the shell of maximum cross-sectional fairing dimension forming an insertion opening through which entry of the diver wearing the equipment is accommodated, and vent means formed in the torso covering shell section spaced between said location on the shell and said insertion opening for preventing water displacement by gas within the fairing.

4. The fairing as defined in claim 3, wherein the head covering section of the shell is made of transparent material for diver viewing purposes as compared to the semi-rigid material of the torso covering shell section that is opaque.

5. In combination with a fairing for protectively enclosing head and torso of a diver during movement underwater, said fairing having a head shell section extending from one axial end thereof and a torso shell section interconnected therewith with an insertion opening at an opposite axial end thereof for receiving the diver within the fairing, the improvement residing in: means for enhancing said underwater movement under positive buoyancy conditions, comprising: a plurality of weights; and means for positioning said weights at a plurality of appropriately distributed axially spaced locations only inside of the torso shell section to oppose upward forces on the fairing with the diver therein under said positive buoyancy conditions.

* * * * *